US009177743B2

(12) United States Patent
Lee

(10) Patent No.: US 9,177,743 B2
(45) Date of Patent: Nov. 3, 2015

(54) ELECTROMAGNETIC SWITCHING DEVICE

(71) Applicant: LSIS CO., LTD., Anyang-si, Gyeonggi-do (KR)

(72) Inventor: Sang Jin Lee, Daegu (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/914,151

(22) Filed: Jun. 10, 2013

(65) Prior Publication Data

US 2013/0335176 A1 Dec. 19, 2013

(30) Foreign Application Priority Data

Jun. 14, 2012 (KR) ..... 10-2012-0063739

(51) Int. Cl.

| | |
|---|---|
| ***H01H 3/00*** | (2006.01) |
| ***H01H 51/00*** | (2006.01) |
| ***H01H 50/04*** | (2006.01) |
| *H01H 50/20* | (2006.01) |
| *H01H 50/54* | (2006.01) |

(52) U.S. Cl.

CPC ..... *H01H 51/00* (2013.01); *H01H 50/042* (2013.01); *H01H 50/045* (2013.01); *H01H 50/20* (2013.01); *H01H 50/546* (2013.01)

(58) Field of Classification Search

CPC ..... H01H 51/52; H01H 51/065; H01H 50/04; H01H 50/20; H01H 1/50; H01H 2050/025; H01F 7/08

USPC ..... 335/187

See application file for complete search history.

(56) References Cited

U.S. PATENT DOCUMENTS

| | | | | |
|---|---|---|---|---|
| 2,373,587 | A * | 4/1945 | Martin-Hurst | 335/166 |
| 2,709,728 | A * | 5/1955 | Tancred | 335/163 |
| 6,229,416 | B1 | 5/2001 | Ebihara et al. | |
| 7,688,169 | B2 * | 3/2010 | Zhao | 335/220 |
| 2009/0322453 | A1 | 12/2009 | Kawaguchi et al. | |
| 2012/0092094 | A1 * | 4/2012 | Lee | 335/78 |
| 2013/0335176 | A1 * | 12/2013 | Lee | 335/187 |

FOREIGN PATENT DOCUMENTS

| | | |
|---|---|---|
| CN | 1701403 | 11/2005 |
| CN | 102456512 | 5/2012 |
| CN | 102456514 | 5/2012 |

(Continued)

OTHER PUBLICATIONS

Korean Intellectual Property Office Application Serial No. 10-2012-0063739, Notice of Allowance dated Dec. 26, 2013, 2 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

Disclosed is an electromagnetic switching device. The electromagnetic switching device includes a case defining an outer appearance; a fixed contact point assembly received in the case and including a fixed contact point; a coil terminal assembly detachably coupled to one side of the fixed contact point assembly and including a coil; and a shaft assembly detachably inserted into the coil terminal assembly, wherein the shaft assembly includes a shaft movable in the coil terminal assembly.

7 Claims, 7 Drawing Sheets

(56) References Cited

FOREIGN PATENT DOCUMENTS

| | | |
|---|---|---|
| EP | 2141723 | 1/2010 |
| EP | 2442331 | 4/2012 |
| JP | 2001-023494 | 1/2001 |
| JP | 2003-269638 | 9/2003 |
| JP | 2005-038706 | 2/2005 |
| JP | 2012-089484 | 5/2012 |
| KR | 10-1034371 | 5/2011 |
| KR | 10-1073108 | 10/2011 |
| KR | 10-1090501 | 12/2011 |

OTHER PUBLICATIONS

European Patent Office Application Serial No. 13171447.9, Search Report dated Oct. 18, 2013, 8 pages.
Japan Patent Office Application Serial No. 2013-124460, Office Action dated Jun. 9, 2014, 2 pages.
Japan Patent Office Application Serial No. 2013-124460, Office Action dated Oct. 23, 2014, 2 pages.
The State Intellectual Property Office of the People's Republic of China Application Serial No. 201310236982.X, Office Action dated Jan. 22, 2015, 6 pages.

* cited by examiner

ELECTROMAGNETIC SWITCHING DEVICE

CROSS-REFERENCE TO RELATED APPLICATIONS

Pursuant to 35 U.S.C. §119(a), this application claims the benefit of earlier filing date and right of priority to Korean Patent Application No. 10-2012-0063739, filed on Jun. 14, 2012, the contents of which is incorporated by reference herein in its entirety.

BACKGROUND

The embodiment relates to an electromagnetic switching device.

An electromagnetic switching device is a kind of an electrical contact switching device for supplying or shutting off current, and may be used for various industrial equipments, machines or vehicles.

Hereinafter, an electromagnetic switching device according to the related art will be described with reference to accompanying drawings.

FIG. 1 is a sectional view showing an electromagnetic switching device which is in a power-off state according to the related art. FIG. 2 is a sectional view showing an electromagnetic switching device which is in a power-on state according to the related art.

Referring to FIGS. 1 and 2, the electromagnetic switching device 1 according to the related art includes a frame 20, a fixed contact point 21 fixed to the frame 20, a movable contact point 40 which can make contact with and can be separated from the fixed contact point 21, and an electric actuator 30 which drives the movable contact point 40.

The electric actuator 30 may include a coil 31 for generating electromagnetic force, a fixed core 32 fixed in the coil 31, a movable core 33 movable closely to or away from the fixed core 32, a shaft 34 having one end connected to the movable core 33 and the opposite end connected to the movable contact point 40, and a return spring 35 for applying elastic force to the movable core 33 in order to allow the movable core 33 to be spaced apart from the fixed core 32.

A wipe spring 50, which applies an elastic force to the movable contact point 40 to allow the movable contact point 40 to make contact with the fixed contact point 21, may be provided at the one end of the shaft 34. A spring support part 341, which makes contact with the wipe spring 50 to support the wipe spring 50, may be provided to the shaft 34. A stopper 321, which makes contact with the spring support part 341 to limit the movement of the shaft 34, may be provided to the fixed core 32.

According to the configuration described above, when supplying electric power, the electric power is applied to the coil 31 so that an electromagnetic force is generated near the coil 31. Thus, the movable core 33 moves closely to the fixed core 32, so that the movable contact point 40 makes contact with the fixed contact point 21.

Meanwhile, when the electric power is shut off, the supply of the electric power to the coil 31 is shut off, so that the movable core 33 returns to the initial position by the elastic force of the return spring 35. Thus, the movable contact point 40 is separated from the fixed contact point 21 so that the electric power is shut off.

A process of fabricating the electromagnetic switching device mainly includes three steps.

The first step is a process of fabricating a shaft assembly. After the shaft 34, the movable core 33, the fixed core 32 and the plate 60, which are components necessary for fabricating the shaft assembly, are stacked, a lower end portion of the shaft 34 is completely fixed to the movable core 33 through a laser welding scheme.

The second step is a process of fabricating a mechanism assembly. The concerned components (such as a coil, a yoke 70 or a frame) are stacked and combined at an upper side or lower side of the shaft assembly fabricated in the first step. Since the combination is an irreversible process, if a malfunction is found after the combination, the entire mechanism assembly must be scraped.

The third step is a final assembling step of completing the electromagnetic switching device.

The case 10 is coupled with the mechanism assembly assembled in the first and second steps. Since a structure for fixing the two components after finishing the coupling does not exist, the two components are coupled by coating epoxy on a coupling portion. If the finished product is completed, a basic property test for the product is performed. If a malfunction is found from the finished product in the test, the finished product is discarded.

As described above, the electromagnetic switching device according to the related art has a problem in that great mutual dependence exists between the components. That is, in the processes of performing each step, a next process is performed by coupling an additional component with the assembly fabricated in a previous process. Thus, since each component is completely coupled, when a failure is found from some components after finishing the assembling work, the entire assembly or finished product must be discarded. Further, because of the sequential fabricating process, if a problem is caused in one of the entire processes, the entire processes for producing the finished product may be delayed.

SUMMARY

The embodiment provides an electromagnetic switching device, in which only a component determined as a defective component can be exchanged during the process of fabricating the electromagnetic switching device.

According to the embodiment, there is provided an electromagnetic switching device including a case defining an outer appearance of the electromagnetic switching device; a fixed contact point assembly received in the case and including a fixed contact point; a coil terminal assembly detachably coupled to one side of the fixed contact point assembly and including a coil; and a shaft assembly detachably inserted into the coil terminal assembly, wherein the shaft assembly includes a shaft movable in the coil terminal assembly.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
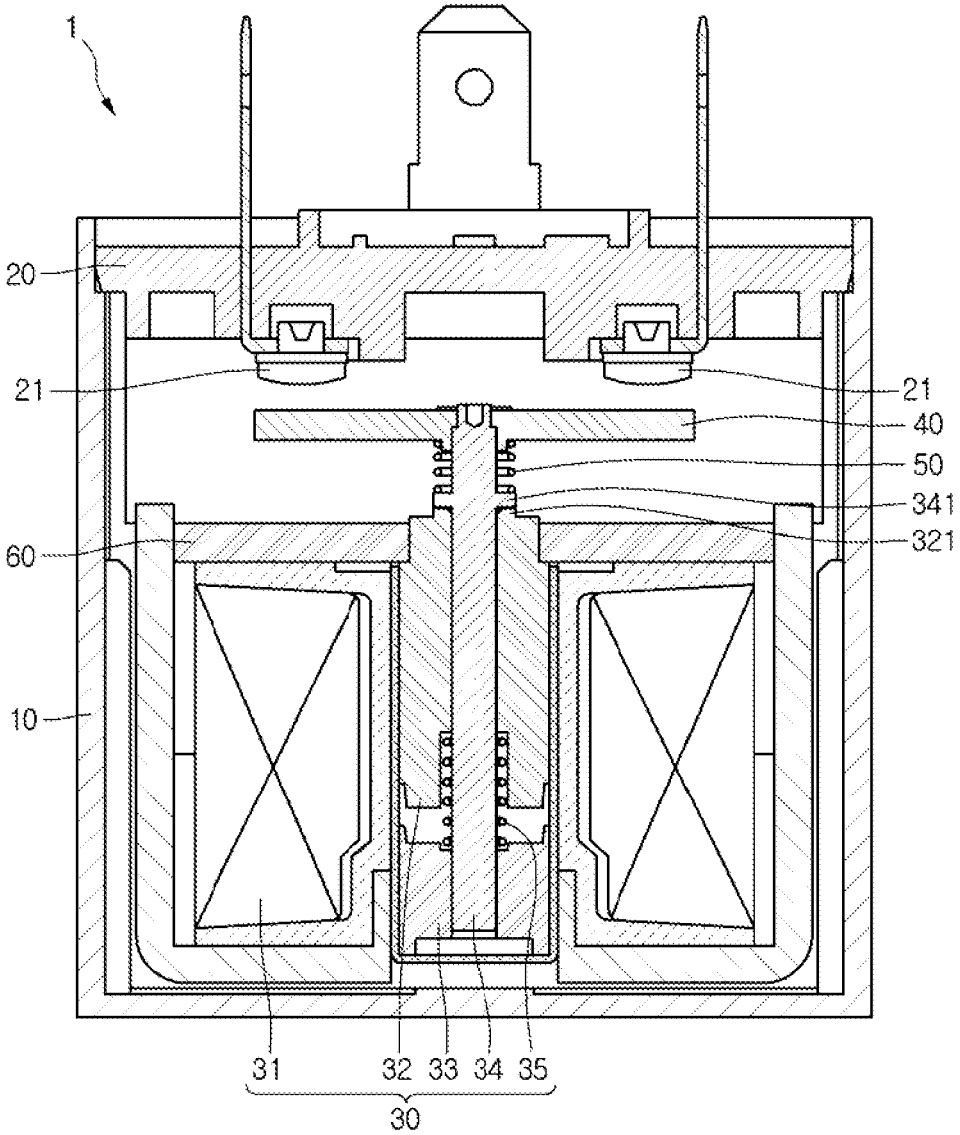
Fig.1 Prior Art
FIG. 1 is a sectional view showing an electromagnetic switching device which is in a power-off state according to the related art.
Figure 2:
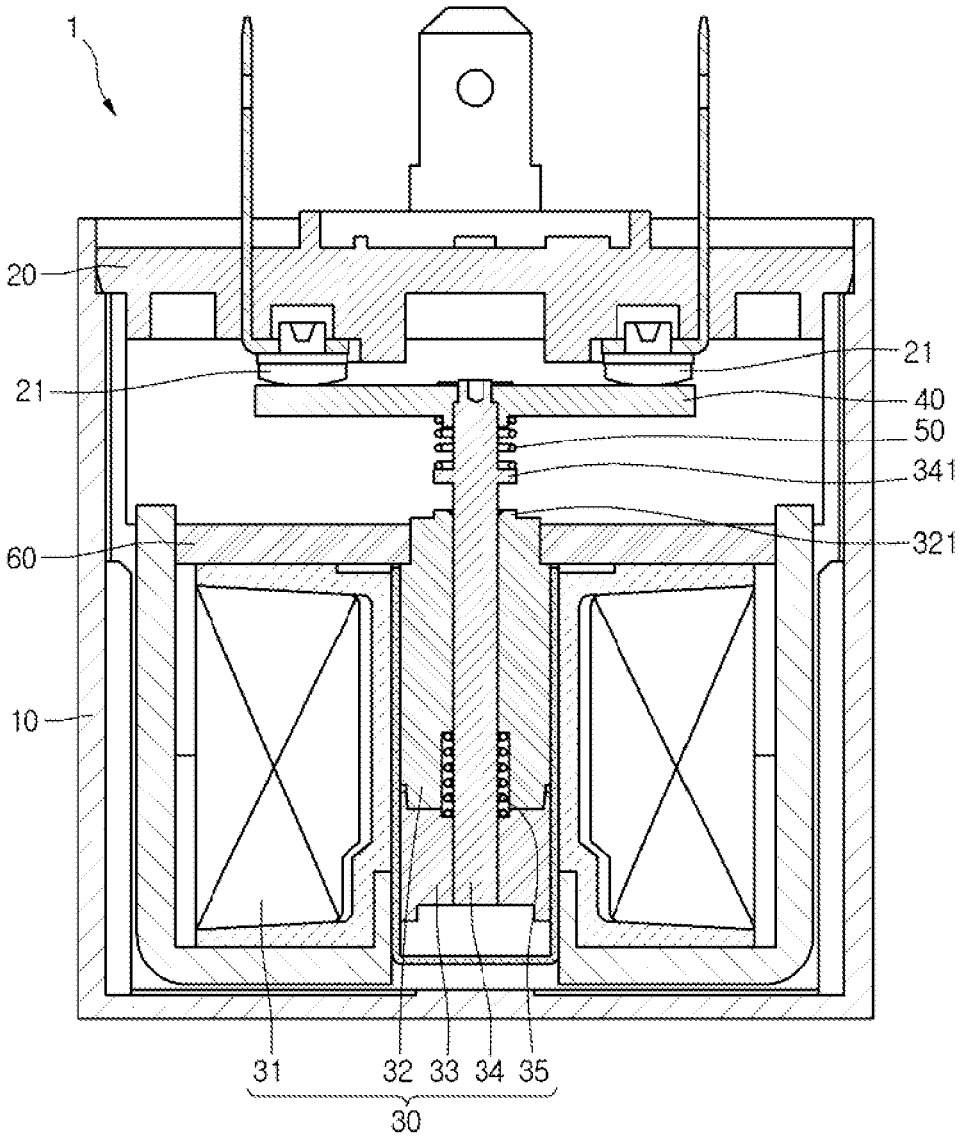
Fig. 2 Prior Art
FIG. 2 is a sectional view showing an electromagnetic switching device which is in a power-on state according to the related art.
Figure 3:
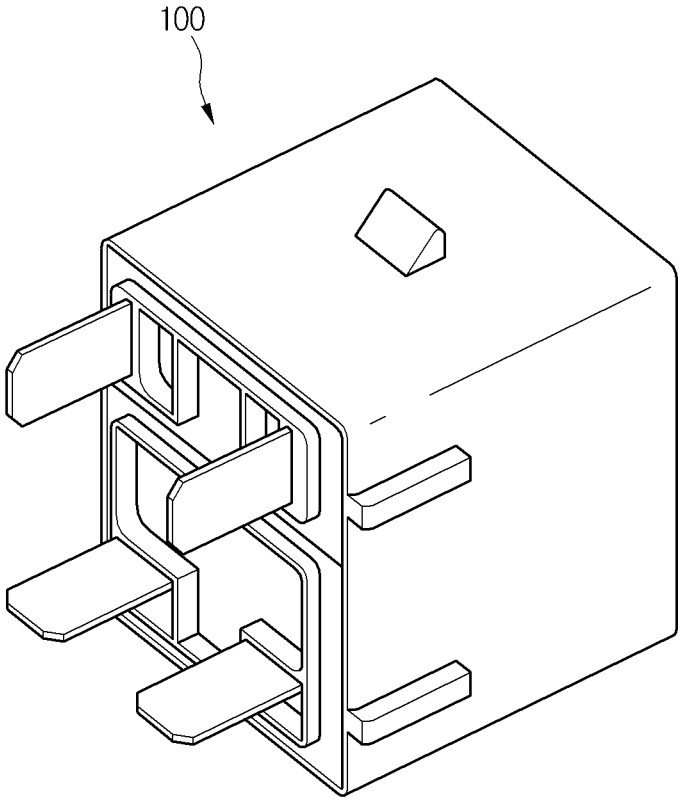
FIG. 3 is a perspective view showing an electromagnetic switching device according to the embodiment.
Figure 4:
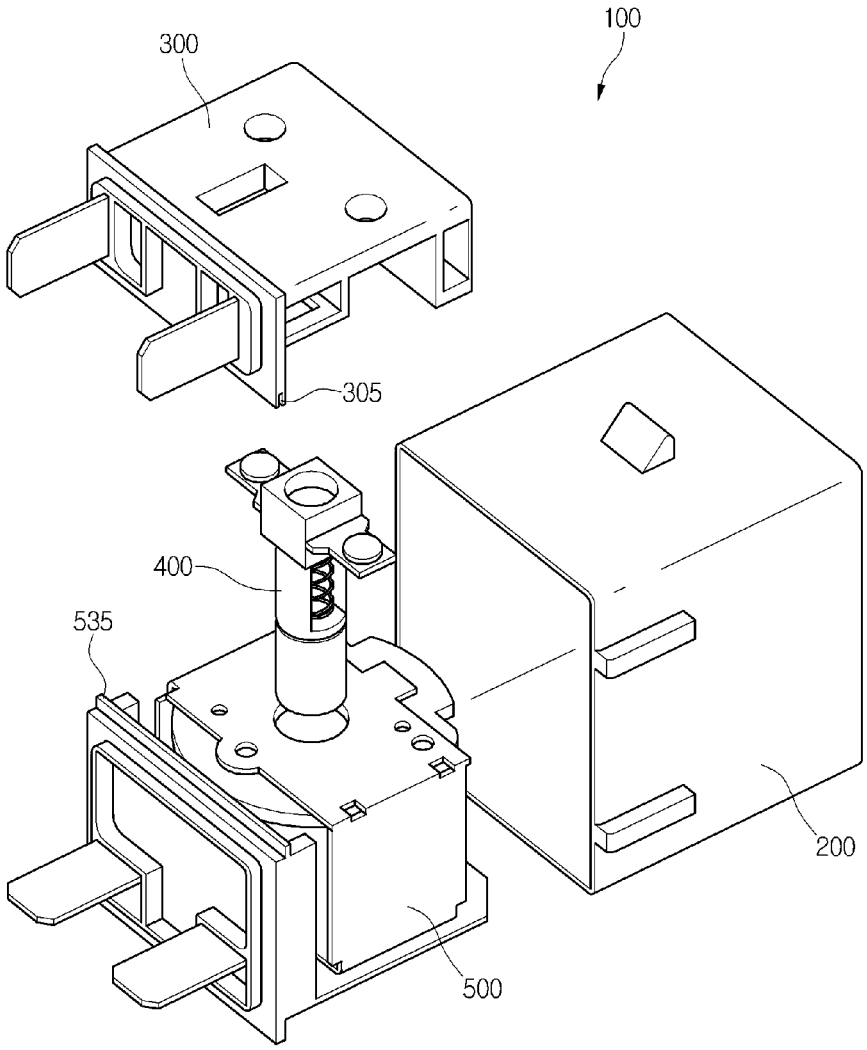
FIG. 4 is an exploded view showing an electromagnetic switching device according to the embodiment.

FIGS. 3 and 4 are a sectional view and a perspective view showing an electromagnetic switching device according to the embodiment, respectively.

Referring to FIGS. 3 and 4, the electromagnetic switching device 100 according to the embodiment includes a case 200 of defining an outer appearance, a fixed contact point assembly 300 including a fixed contact point and a frame, a coil terminal assembly 500 including a coil for generating an electromagnetic force when a current is supplied thereto, a shaft assembly 400 coupled to the coil terminal assembly 500.

The case 200, the fixed contact point assembly 300, the coil terminal assembly 500 and the shaft assembly 400 may be separated from or coupled to each other.

Hereinafter, a process of assembling the electromagnetic switching device will be described in brief.

A hole for coupling the shaft assembly 400 to the coil terminal assembly 500 is formed on a top surface of the coil terminal assembly 500 such that the shaft assembly 400 may be coupled to the coil terminal assembly 500 through the coupling hole. The fixed contact point assembly 300 may be secured on an upper portion of the shaft assembly 400.

The fixed contact point assembly 300 may be coupled to one side portion of the coil terminal assembly 500. The assemblies 300 to 500 are inserted into the case 200 so that the electromagnetic switching device 100 is assembled.

For example, a coupling groove 305 may be formed in the fixed contact point assembly 300. A coupling protrusion 535, which is coupled to the coupling groove 305, may be formed on the fixed contact point assembly 300. The coupling protrusion 535 may be coupled to the coupling groove 305, so that the electromagnetic switching device 100 may be assembled. But, the embodiment is not limited to the scheme of assembling the electromagnetic switching device 100.

Although one assembly is coupled into a case in the relay art, three assemblies 300, 400 and 500 are coupled into the case 200 in the embodiment. In addition, since the assemblies are reversibly coupled to each other, even if any one of the assemblies is out of order, the other assemblies may be continuously used by exchanging only the bad assembly without scrapping all of the assemblies.

Figure 5:
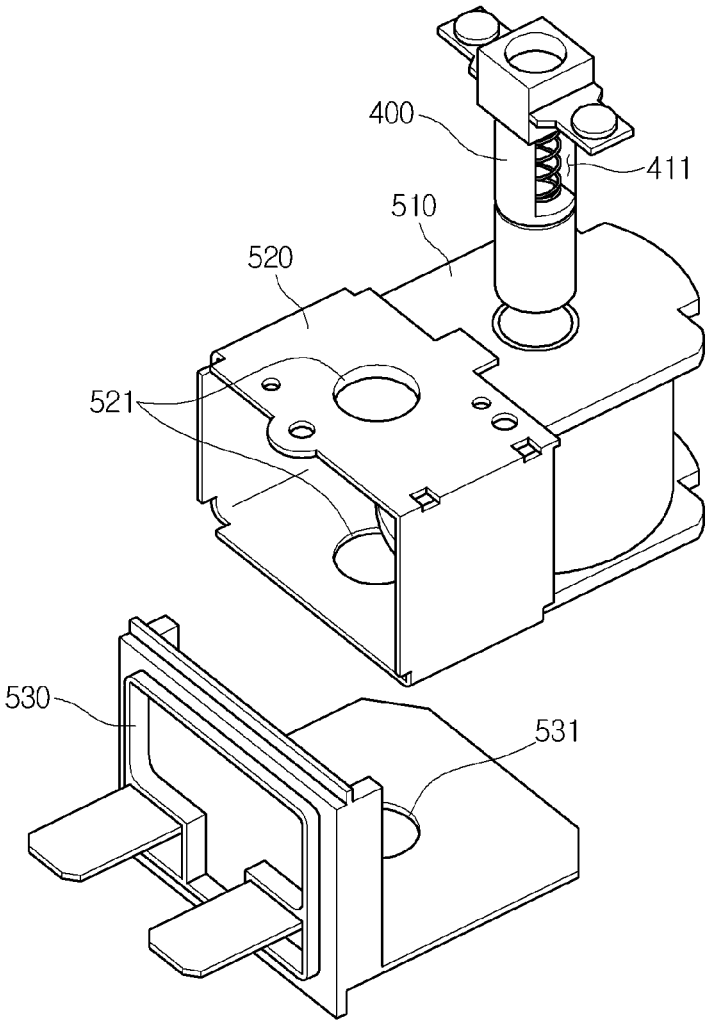
FIG. 5 is an exploded view showing a shaft assembly and a coil assembly according to the embodiment.
Figure 6:
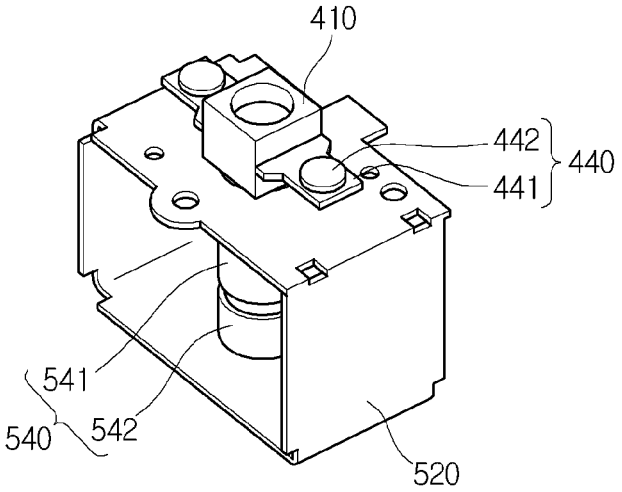
FIG. 6 is a perspective view showing a shaft assembly according to the embodiment.
Figure 7:
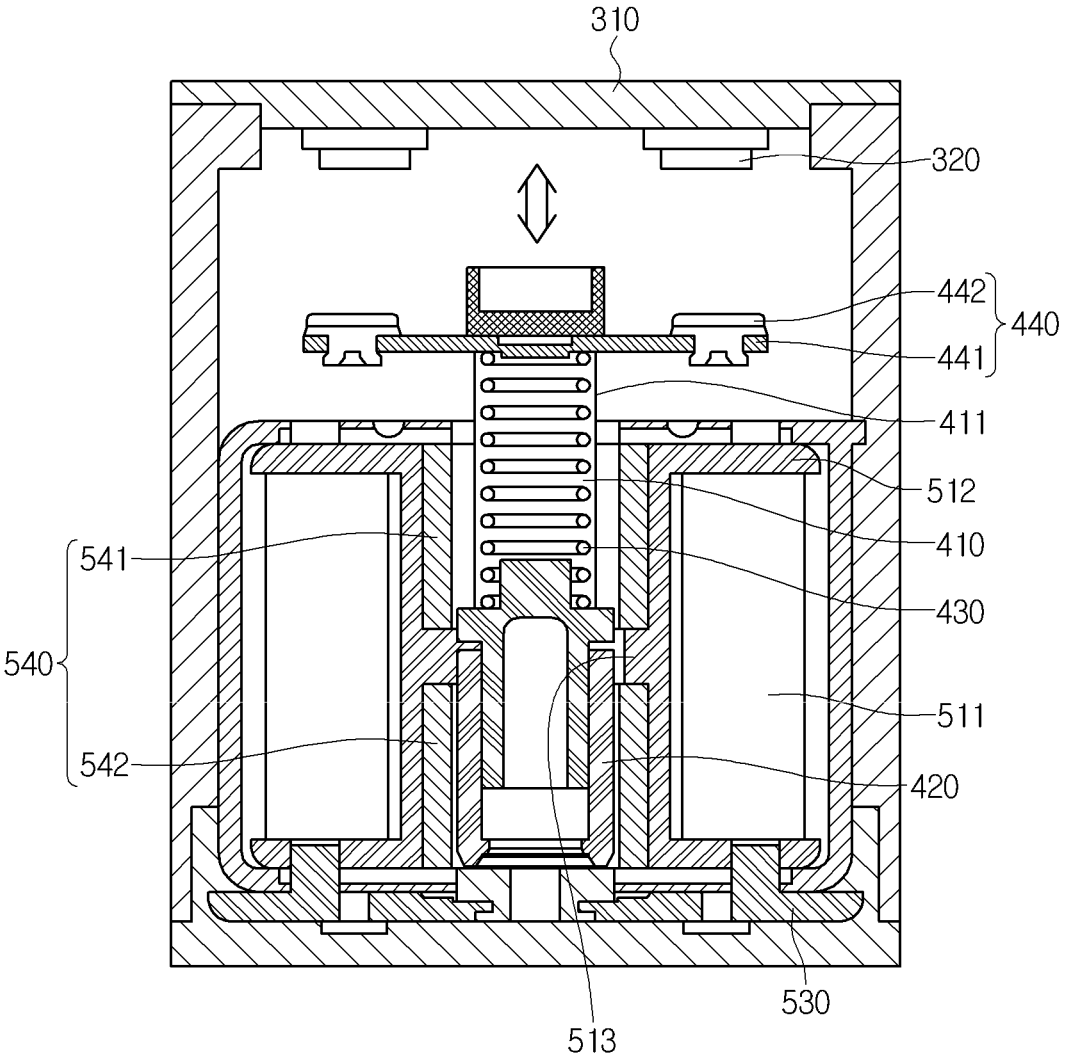
FIG. 7 is a view illustrating an operation of an electromagnetic switching device according to the embodiment.

FIG. 5 is an exploded view showing the shaft assembly and the coil assembly according to the embodiment. FIG. 6 is a perspective view showing a shaft assembly according to the embodiment. FIG. 7 is a view illustrating an operation of an electromagnetic switching device according to the embodiment.

Referring to FIGS. 5 to 7, the shaft assembly 400 includes a shaft 410 in which an opening 411 is formed, a movable core 420 connected to a lower portion of the shaft 410, an elastic member 430 placed in the shaft 410 to provide an elastic force when the shaft 410 moves, and a movable contact point assembly 440 connected to the shaft 410.

The movable contact point assembly 440 includes a movable contact point 442 and a contact point support part 441 fixed to the shaft 410 through the opening 411 to support the movable contact point 442. That is, the opening 411 is formed at a portion of one surface of the shaft 410, and the contact point support part 441 may be inserted into the opening 411. Thus, the contact support part 441 may be easily separated from or coupled to the shaft 410.

The movable contact point 442 may be separated from or make contact with the fixed contact point 320 placed at one side of the fixed contact point assembly 300. If a plurality of fixed contact points 320 are provided, a plurality of the movable contact points 442 may be provided corresponding to the fixed contact points 320 so that the movable contact points 442 may face the fixed contact points 320, respectively. Further, the fixed contact point 320 may be placed and fixed at the fixed panel 310 which is one element of the fixed contact point assembly 300.

The coil terminal assembly 500 may include a coil assembly 510 including a coil 511 through which a current passes, an external yoke 520 which surrounds the outer surface of the coil assembly 510, and a housing 530 coupled to the external yoke 520.

The coil assembly 510 includes the coil 511, the frame 512 which receives the coil 511, and an internal yoke 540 received in the frame 512. The internal yoke 540 includes a first internal yoke 541 and a second internal yoke 542 spaced apart from the first internal yoke 541. For example, the second internal yoke 542 may be placed under the first internal yoke 541.

The first internal yoke 541 may be inserted into the frame 512 from an upper portion of the frame 512. The second internal yoke 542 may be inserted into the frame 512 from a lower portion of the frame 512.

A protrusion 513, which is protruded toward the internal yoke 540 and has a predetermined length, may be formed at the frame 512. The protrusion 513 may be formed at an interface between the first and second internal yokes 541 and 542 such that the positions of the first and second internal yokes 541 and 542 are fixed.

The shaft 410 and the movable core 420 according to the embodiment may be inserted into the internal yoke 540. The shaft assembly 400 may move upward or downward according to the ON/OFF state of the electric power. In this case, the first and second internal yokes 541 and 542 guides the upward and downward movements of the shaft assembly 400.

The first and second internal yokes 541 and 542 may surround an outer surface of the shaft assembly 400. For example, the first and second internal yokes 541 and 542 may have a shape of a cylinder having opened top and bottom surfaces.

In detail, the first internal yoke 541 may be formed to surround a part of the outer surface of the shaft 410, and the second internal yoke 541 may be formed to surround a part of the outer surface of the movable core 420. For example, the external yoke 520 may have a shape of a cuboid having opened two surfaces and surrounding the four surfaces of the coil assembly 510. In addition, for example, the housing 530 may have an L-shape so that one surface of the housing 530 makes contact with a lower surface of the external yoke 520 and the housing 530 surrounds one surface of an opened space of the external yoke 520.

A first hole 521 is formed in the external yoke 520 such that the shaft assembly 400 may pass through the first hole 521. Further, a second hole 531 is formed at one surface of the housing 530 such that the shaft assembly 400 passes through the second hole 531. The positions of the first and second holes 521 and 531 correspond to each other.

The external yoke 520 is formed by coupling two frames to each other. For example, the two frames may be coupled to each other through a caulking process which is utilized for filling a gap.

Further, one side of the housing 530 may be detachably coupled to one side of the fixed contact point assembly 300. In detail, the coupling protrusion 535, which is coupled to the coupling groove (referring to reference numeral 305 in FIG. 4) formed at the fixed contact point assembly 300, may be formed at the housing 530. Therefore, after the coupling groove (referring to reference numeral 305 in FIG. 4) and the coupled protrusion 535 formed at the housing 530 are coupled to each other, the coupling groove and the coupled protrusion 535 are received in the case of forming an outer appearance so that the electromagnetic switching device 100 is assembled.

In the embodiment, the assembly, which results from coupling the coil assembly 510, the external yoke 520 and the housing 530 with each other, is called the coil terminal assembly 500. In addition, the coil assembly 510, the external yoke 520 and the housing 530 may be detachably coupled to each other. Further, predetermined holes are formed at corresponding places of the coil assembly 510, the external yoke 520 and the housing 530, respectively. The shaft assembly 400 is inserted into the holes so that the positions of the coil assembly 510, the external yoke 520 and the housing 530 may be fixed.

That is, the shaft assembly 400 is received in the coil terminal assembly 500 and the fixed contact point assembly 300 including the fixed contact point 320 is detachably coupled to an upper portion of the shaft assembly 400.

The fixed contact point assembly 300 may include the fixed panel 310 including the fixed contact point 320. The coupling groove (referring to reference numeral 305 in FIG. 4) is formed at one side of the fixed panel 310 such that the electromagnetic switching device 100 may be fabricated.

Hereinafter, the operation of the electromagnetic switching device 100 will be described in detail.

In a power-on state, an electric power is applied to the coil 511 so that a magnetic flux is generated near the coil 511. Thus, the movable core 420 moves in a direction in which the magnetic resistance is reduced, that is, upward. When the movable core 420 moves upward, an elastic power is accumulated while the elastic member 430 is being compressed. As the movable core 420 moves, the shaft 410 moves at the same time such that the movable contact point 442 connected to one side of the shaft 410 makes contact with the fixed contact point 320 fixed to one side of the fixed contact point assembly 300, so a current can flow therethrough.

Meanwhile, in a power-off state, the power supply to the coil 511 is shut off. Thus, the coil 511 stops generating the magnetic force and the movable core 420 returns to the initial position due to the elastic force. At the same time as the movable core 420 moves, the shaft 410 moves and the movable contact point 442 is separated from the fixed contact point 320, so that the current is shut off.

According to the embodiment, the internal yoke exists in the shaft assembly without the fixed core. The movable core moves upward and downward through the internal yoke so that the shaft moves upward and downward. In this case, the movable core is movably inserted into the internal yoke in the state that the movable core is coupled to the shaft. That is, the movable core and the shaft are not fixed to the internal yoke. Therefore, the subcomponents constituting the finished product are mutually coupled with each other in a simple stack structure with reprocity property. Thus, even if one of the subcomponents is defective, other subcomponents can be reused by exchanging only the defective component.

That is, according to the related art, a fixed core is used for controlling a degree of the upward or downward movement of the shaft assembly. However, due to the fixed core, the components are coupled with each other through a non-reciprocity process. According to the embodiment, since the electric power of the electromagnetic switching device is controlled through only the shaft and movable core mutually coupled to each other, the shaft assembly can be easily separated from the electromagnetic switching device.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electromagnetic switching device, comprising:

a case defining an outer appearance of the electromagnetic switching device;

a fixed contact point assembly detachably inserted into the case and including a fixed contact point;

a coil terminal assembly detachably coupled to one side of the fixed contact point assembly and including a coil assembly and a frame, the coil assembly including a coil and an internal yoke that are received in the frame; and a shaft assembly detachably inserted into the coil terminal assembly, wherein the shaft assembly includes:

a shaft formed with an opening and movable in the coil terminal assembly;

a movable core connected to a lower side of the shaft;

an elastic member received in the shaft; and a movable contact point assembly connected to the shaft, wherein the movable contact point assembly includes:

a movable contact point selectively contacting the fixed contact point; and a contact point support part inserted into the opening and fixed to one side of the shaft, the contact point support part supporting the movable contact point, wherein the internal yoke includes a first internal yoke spaced apart from a second internal yoke, wherein the first internal yoke is inserted into the frame from an upper portion of the frame and the second internal yoke is inserted into the frame from a lower portion of the frame, wherein the frame includes a protrusion formed at an interface between the first and second internal yokes and configured to fix positions of the first and second internal yokes, and wherein the fixed contact point assembly further includes a groove and the coil terminal assembly further includes a protrusion that is detachably coupled to the groove and the shaft assembly is detachably coupled to the coil terminal assembly such that each of the contact point assembly, the coil terminal assembly and the shaft assembly are separately detachable.

2. The electromagnetic switching device of claim 1, wherein the shaft is inserted into the first and second internal yokes.

3. The electromagnetic switching device of claim 1, wherein one surface of the protrusion protrudes a predetermined distance toward the internal yoke.

4. The electromagnetic switching device of claim 2, wherein the coil terminal assembly further includes:

an external yoke surrounding a portion of an outer surface of the frame; and a housing coupled to the external yoke.

5. The electromagnetic switching device of claim 4, wherein:

the external yoke and the housing each have holes; and the shaft passes through the holes.

6. The electromagnetic switching device of claim 1, wherein the coil terminal assembly further includes a housing on which that coupling protrusion is formed.

7. The electromagnetic switching device of claim 6, wherein the fixed contact point assembly further includes:

a fixed panel provided with the fixed contact point, the fixed panel formed at one side of the fixed contact point assembly.

* * * * *